United States Patent [19]

Bergeson

[11] 4,263,489

[45] Apr. 21, 1981

[54] SWITCH ADJUSTMENT MECHANISM

[75] Inventor: Richard P. Bergeson, Newton, Iowa

[73] Assignee: The Maytag Company, Newton, Iowa

[21] Appl. No.: 72,090

[22] Filed: Sep. 4, 1979

[51] Int. Cl.[3] ..... H01H 35/34

[52] U.S. Cl. ..... 200/81 R; 200/83 WM; 337/319

[58] Field of Search ..... 74/107; 337/93, 94, 337/318, 319, 361; 200/61.2, 81 R, 83 R, 83 WM, 83 P, 83 S, 83 SA, 83 Z, 153 SC, 286, 290

[56] References Cited

U.S. PATENT DOCUMENTS

| | | | |
|---|---|---|---|
| 3,110,784 | 11/1963 | Williams | 200/83 P |
| 3,579,284 | 5/1971 | Mason | 200/83 WM |
| 3,636,490 | 1/1972 | Pansing | 337/93 |
| 3,875,359 | 4/1975 | Backus | 337/319 |

OTHER PUBLICATIONS

Infinite Level Pressure Switch Assembly, Controls Company of America, Part #738-278-2, See Photos.

*Primary Examiner*—Gerald P. Tolin
*Attorney, Agent, or Firm*—Richard L. Ward

[57] ABSTRACT

A laundry appliance is provided with a pressure responsive switch operable for detecting fluid levels in a fluid container. The switch is secured to mounting bracketry including a guideway within which a slider member is movable. A cam portion of the slider member contacts a switch adjustment lever and movement of the slider member within the guideway moves the cam portion relative to the adjustment lever and determines the fluid level attainable in the container by changing the switch setting. The slider member is removable from the bracketry and is replaceable with other slider members having modified cam surfaces corresponding to different fluid levels.

12 Claims, 4 Drawing Figures

SWITCH ADJUSTMENT MECHANISM

BACKGROUND OF THE INVENTION

Prior art pressure responsive switches used for fluid level detection in appliances have generally been adjusted through a rotary cam actuator or a push button control to adjust or set a fluid level. One prior art device utilizes, in one embodiment, a slider bar which must be pushed inwardly to first reset the pressure switch and thereafter may be moved laterally by means of a pair of slotted holes in the slider bar which allow movement of the slider bar relative to a pair of headed studs secured to the mounting bracketry.

Another prior art device which utilizes a slider arrangement includes a metal plate which is operable for sliding movement with respect to a stationary flange portion of the mounting bracket. The stationary flange includes an elongated slot with the slider juxtaposed thereto and movable in a plane parallel to the stationary flange and the slot by means of a pair of rivets which extend through the slot and into a second plate whereby the stationary flange is captured between the slider and the second plate. A pair of rollers are captured between the two plates within the slot and enhance movement of the slider. The slider plate further includes a cam surface for engaging with an adjustment portion of the switch.

SUMMARY OF THE INVENTION

It is therefore an object of the instant invention to provide an improved adjustable pressure switch assembly.

It is a further object of the instant invention to provide an adjustable pressure switch assembly which may utilize a plurality of interchangeable slider members.

It is a still further object of the instant invention to provide an adjustable pressure switch assembly having mounting bracketry which provides an improved sliding bearing surface for movement of the slider member.

Briefly, the instant invention achieves these objects in an adjustable pressure responsive switch assembly including a pressure actuated switch mechanism. An adjustable element is associated with the switch mechanism for effectively varying the relative pressure at which the switch mechanism will actuate. A bracket supports the switch mechanism and defines an elongated guideway operatively juxtaposed to the adjustable element. An elongated unitary slider member is movable within the guideway and includes a cam for engaging with and effecting movement of the adjustable element to vary the adjustment of the switch mechanism as the slider member is moved. Mechanism is provided for mounting the unitary slider member within the guideway of the bracket including a pair of spaced apart rails on one of the bracket or slider member and cooperable with a pair of grooves formed in the other of the bracket or slider member, the unitary slider member being manually operable for sliding movement relative to the guideway to effect the adjustment of the switch mechanism.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
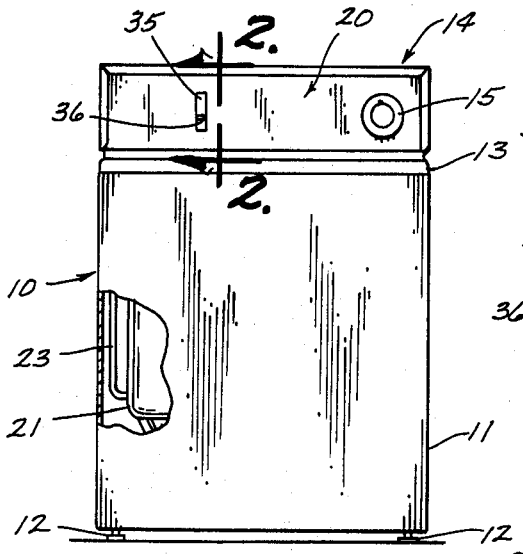
FIG. 1 is a general front view of an automatic washing machine showing the control panel surface and partially broken away to show the washing machine tube.

Referring now to the drawings there is shown in FIG. 1 an automatic fabric washing machine 10. The washing machine 10 includes a wrap-around cabinet 11 which surrounds a base frame (not shown) supported on a plurality of adjustable legs 12. The cabinet 11 further includes a top cover 13 having a hinged access door (not shown) normally covering a loading opening. The top cover 13 mounts an upwardly extending housing 14 for accommodating the various control members such as programming means actuatable by a dial 15. Also included among the various control members could be switches for providing temperature selections, wash-spin speeds, soak option and water level selection.

Figure 2:
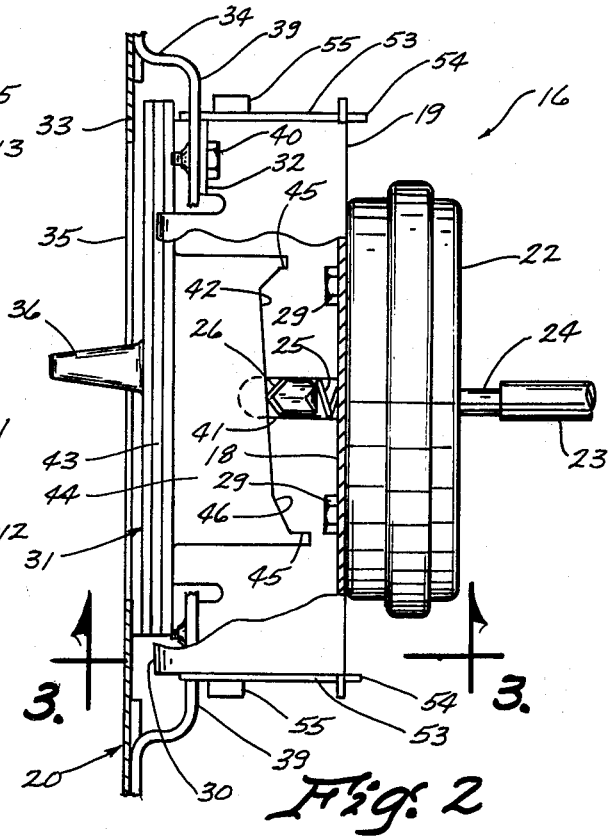
FIG. 2 is a fragmentary sectional view taken generally along lines 2—2 of FIG. 1 and partially broken away to show the pressure switch adjustment assembly.
Figure 3:
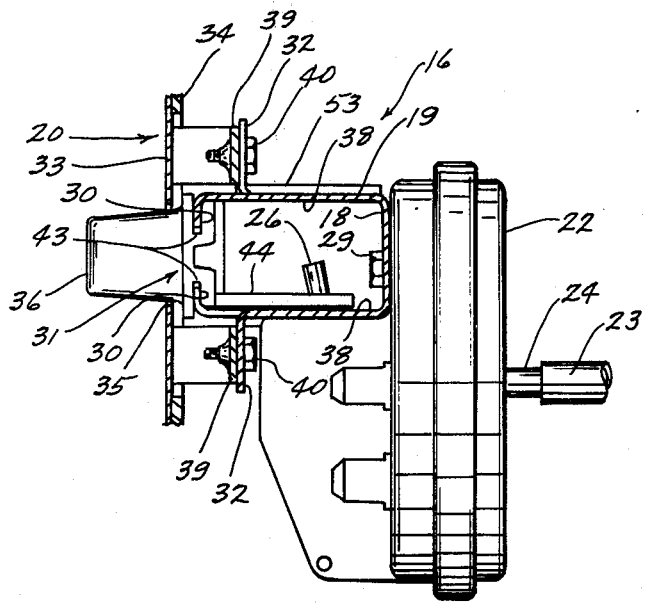
FIG. 3 is a section view taken generally along lines 3—3 of FIG. 2 and further showing the adjustment assembly.

Turning now to FIGS. 2 and 3, there is shown a pressure responsive switch assembly 16 including a bracket 19 mounted behind the front panel 20 of the upwardly extending housing 14.

In an automatic fabric washing machine a pressure responsive switch assembly 16 is typically used for controlling the fluid fill valve to obtain various selected fluid levels in the fluid container or tub 21. The pressure switch mechanism 22 may be connected to the tub 21 by means of a pressure tube 23 connected near the bottom of the tub 21 and to the switch 22 at the nipple 24. The switch 22 is responsive to pressure differentials, such as those produced by the height of the fluid in the washing machine tube 21. This pressure differential is the pressure differential between the level of fluid in the tub 21 as compared to the level of water in the pressure tube 23 which traps air under pressure in the upper part of the pressure tube 23. The trapped air applies pressure to a diaphragm within the switch 22 which is operable for opening a switch contact when a predetermined fluid level has been reached in the washing machine tube 21. As shown in FIG. 2, a biasing spring 25 communicates between an adjustable lever 26 and the switch contact-diaphragm area located within the switch 22. As the adjustable lever 26 is varied the amount of biasing force exerted by the spring 25 on the contacts is also varied. Changing the biasing force on the contacts controls the operating point of the switch 22.

The pressure responsive switch mechanism 22 is secured to an elongated mounting bracket 19 which has a rectangular generally box-like cross section as best shown in FIG. 3. When viewing FIGS. 2 and 3, that portion of the mounting bracket 19 directly behind the front panel 20 of the control housing 14 will be considered the top wall or surface of the bracket 19. Therefore, as shown, the pressure switch 22 is secured to the bottom wall or surface 18 of the mounting bracket 19 by appropriate mechanical fasteners 29 driven from within the mounting bracket 19 and into the switch housing.

As best shown in FIG. 3, the top wall or surface of the mounting bracket 19 is formed in such a manner that it is a substantially open wall and a pair of inwardly turned, spaced apart, parallel rails 30 extend the length of each side of the top wall or surface of the mounting bracket 19. These rails 30 form a full length supportive bearing surface and guideway for a slider member 31 operable for traversing the length of the mounting bracket 19 and which will be further discussed herein.

A pair of ears 32, for attaching the mounting bracket 19 behind the front panel 20 of the upwardly extending control housing 14, are also formed from the top wall or surface of the mounting bracket 19. One ear 32 is formed at each end of the mounting bracket 19 at diagonally opposite corners.

FIGS. 2 and 3 also show generally the construction of the visible front surface of the control housing 14. A light gage sheet metal facia plate 33 is placed on top of a heavier gage sheet metal support plate 34. The facia plate 33 includes clearance holes 35 for allowing control dials 15 and knobs 36 to protrude outwardly therethrough. The pressure responsive switch 22 and other controls are attached behind the support plate 34 upon a plurality of rearwardly depressed flanges 39. These flanges 39 are formed by deforming the support plate 34 in these flange areas. The pressure switch mounting bracket 19 is secured behind the support plate 34 by well-known mechanical fasteners 40 which extend through clearance holes in the mounting ears 32 and tap into extruded holes in the flanges 39.

As further shown in FIGS. 2 and 3, the pressure responsive switch 22 includes an adjustable lever 26 which extends into the central portion of the mounting bracket 19 through a slot 41 in a side wall 38 of the mounting bracket 19. As further indicated in the drawings, this adjustable lever 26 is engageable with a cam surface 42 that is integral with a slider member 31.

The elongated unitary slider member 31 in this embodiment is molded of a thermoplastic material having a low coefficient of friction when in sliding contact with a metal surface. The main body of the slider member 31 is generally rectangular in shape and includes a pair of longitudinally extending grooves 43 in the sides of the body for mating with the rails 30 of the mounting bracket 19 as best shown in FIG. 3. An operating knob 36 which is an integral part of the molded slider member 31 protrudes from the top surface of the slider member 31 and extends outwardly through a clearance hole 35 in the support plate 34 and the facia plate 33 of the front panel 20. The knob 36 allows a machine operator to move the slider member 31 longitudinally along the guideway formed by the rails 30 in a plane substantially parallel to the surface of the control housing 14 with the grooves 43 of the slider member 31 riding upon the generally flat upper and lower surfaces of the rails 30. The bearing relationship of the slider member grooves 43 to the guideway rails 30 where the full length of the slider member 31 is supported by the flat surface areas of the rails 30 provides a system having a substantially increased bearing area as compared to constructions utilizing pins and/or rivets and slots. As best shown in FIG. 3, the slider member 31 further includes a downwardly extending wall section 44 adjacent one of the side walls 38 of the mounting bracket 19 and which terminates in a cam surface or profile 42 engageable with the switch adjustable lever 26. As shown in FIG. 2, the cam surface 42 contacts the adjustable lever 26 and is operable for moving the spring biased lever 26 as the slider member 31 is moved longitudinally within the guideway of the mounting bracket 19 to change the switch 22 setting. The biasing force exerted by the spring 25 will tend to keep the lever 26 in contact with the cam surface 42 of the slider member 31. The cam surface 42 is operable for moving the lever 26 in a downward direction and the spring 25 is operable for returning the lever 26 upwardly as allowed by the cam surface 42.

The cam surface or profile 42 shown in FIG. 2 provides a continuous sloping surface which results in an infinite range of adjustment selections for the pressure switch 22 between stops 45 located at a predetermined low and a predetermined high fluid level. There are no definite fluid level stops provided on this cam surface 42 between the high and low levels and the operator is free to select any desired fluid level. The nomenclature provided on the facia plate 33 would, however, provide the operator with a general indication of the fluid level corresponding to the knob 36 setting.

A switch reset cam 46 is provided as an integral part of the cam surface 42 of FIG. 2 should the operator wish to increase the fluid level in the tub 21 by an amount measuring less than two inches after the initial fill. To operate the switch reset, the slider member 31 is moved upwardly so that the reset cam 46 will fully depress the adjustable lever 26 and reset the switch 22 contact to the fill or closed posture. After this reset operation, the tub 21 can be filled with the additional fluid. The pressure switch 22 shown in FIGS. 2 and 3 will automatically reset if the slider member 31 is moved sufficiently to provide an amount of additional fluid greater than two inches in the tub 21 thus making the manual reset operations as described above unnecessary.

Figure 4:
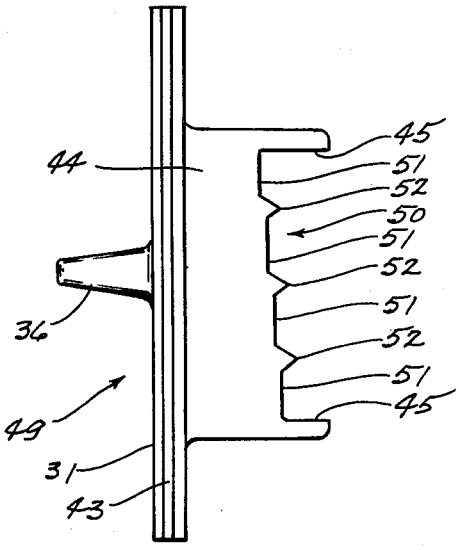
FIG. 4 is a view of an interchangeable slider member having a multilevel cam profile.

FIG. 4 shows a slider member 49 interchangeable with the slider member 31 of FIGS. 2 and 3 and having a modified cam surface 50. The slider member 49 of FIG. 4 has four definite fluid level steps 51 from one end of the cam surface 50 to the other between stops 45 located at predetermined low and high fluid levels. The cam surface 50 is designed to provide two inches of fluid, as measured in the tub 21, between each step 51 which is normally sufficient to reset the pressure switch. The protrusions 52 on the cam surface 50 between the steps 51 insure that the switch 22 will reset between steps 51. It is to be understood that any number of slider members having modified cam surfaces would be possible and interchangeable in the mounting bracket 19.

Therefore, the slider member 49 shown in FIG. 4 is directly interchangeable with the infinite level slider member 31 of FIGS. 2 and 3. By this interchangeability, it is possible to utilize one universal pressure responsive switch assembly 16 and simply interchange slider members for different washing machine models allowing continuity of design and appearance regardless of the number of fluid level selections designed into the cam surface. The pressure switch 22 is initially calibrated for a predetermined maximum high fluid level and the slider members such as 31 and 49 are designed to be interchangeable without recalibration of the pressure switch 22.

In the embodiment shown, each end of the mounting bracket 19 is closed by a removable rectangular cover 53 having a tab 54 at its bottom and a slot on each side. The bottom tab 54 of the cover 53 engages a slot in the bottom wall or surface 18 of the mounting bracket 19 and the side slots register with a pair of the tabs 55, one on each side wall 38 of the mounting bracket 19. Once the covers 53 are positioned at the ends of the mounting bracket 19, they are secured by clinching or twisting the tabs 54 and 55. The slots and tabs 54 and 55 of the covers and the mounting bracket 19 are designed so that assembly of the covers 53 to the mounting bracket 19 will maintain the side walls 38 of the bracket parallel to each other and the guideway rails 30 in their true opposed and parallel posture. In addition to the use of clinched or twisted tabs 54 and 55 in slots, it is anticipated that several state of the art mechanical fasteners could be utilized to maintain the covers 53 in position relative to the mounting bracket 19 walls. The covers 53 are not required for retaining the slider members 31 or 49 in the guideway since stops 45 are formed at each end of the cam surfaces 42 and 50 of the slider members 31 and 49. It is thus anticipated that it would be possible to form the mounting bracket 19 of sufficiently heavy material and with enough accuracy as to totally obviate the need for the covers 53 so that the slider members 31 or 49 would be directly removable from the mounting bracket 19 by manually depressing the adjustable lever 26 an amount sufficient to clear the stops 45.

The present switch adjustment assembly 16 thus provides a simplified adjustment apparatus which is operable for providing a variety of fluid levels in the tub 21 of a washing machine 10 and permits the use of interchangeable slider members 31 or 49 having cam surfaces 42 or 50 designed for different degrees of movement of the adjustable lever 26. The interchangeability of the slider members 31 and 49 allows the use of a universal pressure switch 22 and mounting bracket 19. The use of universal parts on all models greatly reduces inventory requirements while the slider member 31 or 49 allows a continuity of design and appearance throughout the various models of washing machine 10. The mechanism also assures the smooth operation of the slider member by providing an enlarged bearing surface for engagement by the slider members 31 or 49 while maintaining a simplified structure.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. An adjustable pressure responsive switch assembly, the combination comprising: a pressure actuated switch mechanism; an adjustable element on said switch mechanism for effectively varying the relative pressure at which said switch mechanism will actuate; bracket means supporting said switch mechanism and including elongated enclosing structure having one substantially open side defining an elongated guideway operatively juxtaposed to said adjustable element; an elongated unitary slider member movable within said guideway and including cam means for engaging with and effecting movement of said adjustable element to vary the adjustment of said switch mechanism as said slider member is moved; and means mounting said unitary slider member within said guideway of said bracket means including a pair of spaced apart elongated rails on and extending the length of one of said bracket means and slider member and mating with a pair of elongated grooves formed in and extending the length of the other of said bracket means and slider member, said unitary slider member being manually operable for sliding movement relative to said guideway to effect said adjustment of said switch mechanism.

2. An adjustable switch assembly as defined in claim 1 wherein said slider member is removable from said guideway as an integral unit comprising manual operating means, guideway engaging means and cam means.

3. An adjustable switch assembly as defined in claim 1 wherein said elongated enclosing structure has a generally box-like cross section with said open side including a pair of spaced apart rails together defining said guideway.

4. An adjustable switch assembly as defined in claim 3 wherein said slider member includes said pair of grooves in sliding engagement with said rails.

5. An adjustable switch assembly as defined in claim 1 wherein said cam means includes a continuous sloping surface for providing infinitely narrow adjustment of said switch mechanism between predetermined high and low switch settings.

6. An adjustable switch assembly as defined in claim 1 wherein said cam means includes a plurality of steps providing a series of predetermined settings for said switch mechanism.

7. An adjustable pressure responsive switch assembly, the combination comprising: a pressure actuated switch mechanism; an adjustable element on said switch mechanism effectively varying the relative pressure at which said switch mechanism will actuate; bracket means supporting said switch mechanism and including an elongated member having a generally box-like cross section and having one substantially open wall comprising a pair of spaced apart rail members extending the length of said bracket means and defining an elongated guideway operatively juxtaposed to said adjustable element; and an elongated unitary slider member movable within said guideway and including cam means engaging with and effecting movement of said adjustable element to vary the adjustment of said switch mechanism as said slider member is moved, said unitary slider member having a pair of longitudinal grooves formed therein and extending the length of said slider member and mating with said rail members for mounting said unitary slider member within said guideway of said bracket means, said unitary slider member being manually operable for sliding movement relative to said guideway to effect said adjustment of said switch mechanism.

8. An adjustable switch assembly as defined in claim 7 wherein said adjustable element is a lever supported on said switch mechanism.

9. An adjustable switch assembly as defined in claim 8 wherein said slider member includes stop means engageable with said lever for retaining said slider within said guideway with said lever manually movable to release said slider member for disassembly from said guideway.

10. An adjustable switch assembly as defined in claim 9 wherein said slider member is removable from said guideway as an integral unit comprising operating means, guideway engaging means and cam means.

11. An adjustable pressure responsive switch assembly operable for controlling the fluid level in a washing apparatus, the combination comprising: a pressure actuated switch mechanism; an adjustable lever on said switch mechanism effectively varying the relative pressure at which said switch mechanism will actuate; bracket means mounting said switch mechanism including an elongated member of generally box-like cross section having one generally open wall, with said open wall comprising a pair of inwardly facing spaced apart rail members extending the length of said bracket means and together defining a longitudinal open ended guideway operatively juxtaposed to said adjustable lever and presenting substantial surface area for carrying a sliding load; and an elongated unitary slider member having a pair of longitudinal grooves extending the length of said slider member and mating with said rail members in a load bearing posture and manually operable for sliding movement within said guideway, said slider member including a cam surface engageable with said adjustable lever to effect movement of said adjustable lever in conjunction with movement of said slider member.

12. An adjustable switch assembly as defined in claim 11 wherein said slider member includes stop means engageable with said adjustable lever for retaining said slider member within said guideway at the end of said slider movement, said adjustable lever being manually disengageable from said stop means to allow selective removal and replacement of said slider member from said guideway.

* * * * *